United States Patent [19]

Kort et al.

[11] 4,166,613

[45] Sep. 4, 1979

[54] MECHANISM FOR CHIP-CUTTING AND CHIP-EJECTION IN THE PERFORATION OF SIGNATURES

[75] Inventors: Werner Kort, Nürtingen; Ewald Gall, Hochdorf, both of Fed. Rep. of Germany

[73] Assignee: Maschinenbau Oppenweiler GmbH, Oppenweiler, Fed. Rep. of Germany

[21] Appl. No.: 839,586

[22] Filed: Oct. 5, 1977

[30] Foreign Application Priority Data

Oct. 13, 1976 [DE] Fed. Rep. of Germany ..... 2646159

[51] Int. Cl.[2] ..... B41F 13/56

[52] U.S. Cl. ..... 270/21; 270/53; 83/660

[58] Field of Search ..... 270/37, 53, 21, 1; 281/21 R; 11/1 AD; 83/660, 2, 168, 345, 123–124

[56] References Cited

U.S. PATENT DOCUMENTS 2,261,315 11/1941 Thorsen ..... 83/345

2,769,496 11/1956 Spinner ..... 83/660

FOREIGN PATENT DOCUMENTS 2325937 12/1974 Fed. Rep. of Germany ..... 11/1 AD

*Primary Examiner*—Edgar S. Burr

*Assistant Examiner*—A. Heinz

*Attorney, Agent, or Firm*—Hopgood, Calimafde, Kalil, Blaustein & Lieberman

[57] ABSTRACT

The invention contemplates mechanism for perforating signatures for ultimate use in glued binding of the signatures into a book. The perforating mechanism cuts chips in the course of continuous transport of the signatures, and the arrangement is such that the chips are transiently supported and transported out of the chip-cutting zone prior to forced ejection from the mechanism, thereby avoiding any fouling accumulation of retained chips at the cutting zone.

3 Claims, 13 Drawing Figures

55
61
62
57
56
53
48
44
52

55
61
56
57 53
62
48
X
52
44

58
55
61
57
62
53
51
48
44
52
X

MECHANISM FOR CHIP-CUTTING AND CHIP-EJECTION IN THE PERFORATION OF SIGNATURES

BACKGROUND OF THE INVENTION

The invention relates to mechanism used in the perforation of signatures, being mechanism used in a process for binding a book, whereby the single sheets are folded into a signature and the leaves of the signatures are glued to each other and then attached to the book cover, if necessary. Processes of this kind are known under the designation "Adhesive binding process" and the bindings thereby produced as "Adhesive bindings".

The term signature denotes a sheet folded several times, e.g., four times. The last fold, e.g., the fourth fold in a sheet folded four times, forms the signature back or binding edge, in which the leaves of the signature converge and are thus linked with one another in pairs, if the connection at the remaining edges of the sheet is broken, e.g., through cutting of the signature edges. In the following, the term book is to be understood as a product which consists of several superimposed leaves which are joined to one another at one edge, namely at the back of the book. A book can consist of a single sheet or signature. It can however also consist of several signatures, gathered into an inner book and joined to one another at the back of the inner book.

Prior-art signature perforation for the indicated book-binding application is typified by Spinner U.S. Pat. No. 2,769,496, wherein successive teeth of a toothed rotary cutting die on one side of moving signature material are caused to pierce the material and to punch out paper cuttings or chips, directly into an inner volume or space defined by and between two cylindrical cage elements which function as chip-cutting reaction elements on the other side of the material, the cage elements being axially spaced in accordance with the thickness of the cutting die, for assurance of a clean cut. The cage elements and the cutting die rotate on spaced vertical axes, with the moving signature material in a vertical plane therebetween. Volume within the lower cage element is relied upon for the reception of the chips, and circumferentially spaced openings in the lower cage element are relied upon for turbulence and centrifugal action to dispel chip accumulations. But this technique does not provide sufficient assurance against chip accumulation, and the random scattering of chip material is neither neat nor conductive to non-fouling operation of nearby equipment. As a result, production efficiency suffers, and costs can be unpredictable.

BRIEF SUMMARY OF INVENTION

It is an object of the invention to provide improved signature-perforating mechanism for use in the adhesive binding of books. And it is a specific object to provide such mechanism that will not only avoid the above-noted difficulties but will also produce a salable waste product of uniform quality.

To realize the foregoing objects, the invention provides a chip-cutting and reaction-roller blade configuration whrein, for each cut, the chips are necessarily retained by and between the roller blades, for positive transport out of the cutting zone to a specific location where the thus-transported chips are assuredly removed, for accumulation in a single location.

More specifically, in a preferred embodiment, the foregoing objects are achieved in a signature-folding machine with a perforating mechanism positioned at the end of the penultimate folding mechanism; the perforating mechanism comprises three rotary blades driven on their axes, of which the first blade which is rotatable about the first axis is positioned on one side of the sheet path and the second and third blades are so positioned on the other side of the sheet path that they are rotatable about one common axis, that the first blade meshes between the rims of the second and third blades with its rim, and that the rim of the first blade comprises cogs, each of which forms a first transverse cutting edge at its leading end when the first blade rotates, which makes a cut in each single leaf of the sheet, forming the first short side of the rectangular slit, before the cog begins punching out the long sides of the rectangular slit, and that the trailing end of the cog is provided with a projection which forms a second transverse cutting edge which projects so far from the lateral edges of the cog, that it makes a cut in each separate leaf of the sheet, forming the second short side of the rectangular slit, before punching out of the long sides of the slit is completed. The three rotary blades result in a relatively simple and very economical construction of the perforating mechanism in accordance with the invention.

Through the shape of the cog of the first blade in accordance with the invention, it is achieved that the short sides of the rectangular slits are punched out before the adjacent parts of the long sides of the rectangular slits are punched out, so that the chip to be punched out is supported on the perimeter of the second and third blades and thus enables a perfect punching of these short sides of the rectangular slits.

It is here of advantage to make sure that the lateral surfaces of the rims of the second and third rotary blades facing each other lie in parallel planes and thereby define a space which is laterally confined by parallel walls for the insertion of the first blade and for the discharge of the punched chips, and that in this chip removal space an ejector sets to work which ejects the punched out chip from the chip removal space during rotation of the blade. As the chip removal space of the perforating mechanism in accordance with the invention is confined on the sides by parallel walls, the chip punched from the sheet is held between the two walls and taken along (i.e., the chip is transported away from the punching zone) by and in the course of rotation of the second and third blades; the thus-transported chip is then reliably ejected from the chip removal space by the ejector. Thus, during punching no obstruction can be caused by punched out chips.

Finally, the invention also relates to a book produced following the process in accordance with the invention, which consists of at least one signature whose leaves are joined to one another by adhesive binding.

The book in accordance with the invention is characterized in that the signature is provided in its back with a row of recesses, rectangular in the top view, which extend along the back and the depth of which is essentially at least as great as half the thickness of the signature, and that at least the bottoms of these recesses are coated with glue in order to hold the leaves together.

The book in accordance with the invention is characterized in that it can be bound more cheaply than is possible in the known adhesive binding process and that here, the binding of the single pages of the book with each other and with the back of the book is substantially better and firmer than is possible in wire and thread stitching.

The invention is described in detail in the following specification of embodiments of a folding machine in accordance with the invention and of a book in accordance with the invention with the aid of schematic greatly simplified drawings.

Figure 1:
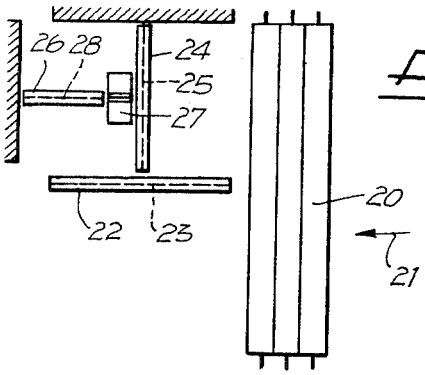
FIG. 1 shows a schematic top view of the folding machine.

The combined four-fold folding machine shown in FIG. 1 comprises a buckle folding mechanism as a first folding mechanism 20, to which the sheet is fed in the feeding direction 21, preferably in its longitudinal direction, and is folded at its middle with a fold perpendicular to the feeding direction 21. In this folded state the sheet is fed into the second folding mechanism 22 which is a blade folding mechanism. The broken line 23 indicates the cutting edge of the folding blade lying underneath, in order to show that in this folding mechanism, the folding blade is positioned above the folding rollers (not shown). Beneath the supporting surface of this second folding mechanism 22, on the right side of its folding blade, a third folding mechanism 24 is positioned, which is likewise a blade folding mechanism, in which the cutting edge of the folding blade is indicated by a dotted line 25. A perforating mechanism 27 is situated between the third folding mechanism 24 and a fourth folding mechanism 26. The fourth folding mechanism 26 is a blade folding mechanism, like the preceding folding mechanisms. The cutting edge of the folding blade is indicated by a dotted line 28.

Figure 9:
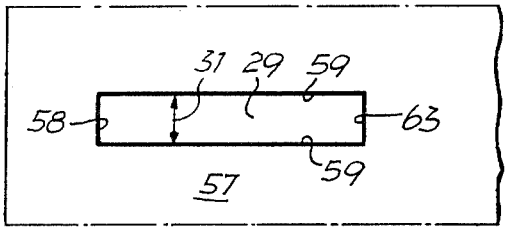

A sheet entering the first folding mechanism 20 in its feeding direction 21 is folded along half its length with a fold perpendicular to its feeding direction 21, and is fed into the folding mechanisms 22, 24 and 26 successively, the last-fold forming the leading edge, whereby in the perforating mechanism 27 the sheet is perforated with a row of rectangular slits 29 (FIG. 9), which extend along the fold line, with their longitudinal axes, along which fold line the sheet is then folded in the last folding mechanism 26. The perforating mechanism 27 described in greater detail in the following, produces rectangular slits whose width 31 (FIG. 9) is as great as the thickness 32 (FIG. 11) of the signature 33, multiplied by $\pi/2$, in the case shown, said signature being folded four times in the folding machine. As can be clearly seen in FIG. 11, the rectangular slits 29 form a row of recesses 34 in the signature back, each of which is confined laterally by two planar walls 35 perpendicular to the longitudinal axis of the signature back and by a concave bottom 36 parallel to the longitudinal axis of the signature back, and the opening of which extends over the whole curve of the back of the signature, so that the glue applied, e.g., by means of a glue wheel, can easily penetrate the recesses.

Figure 13:
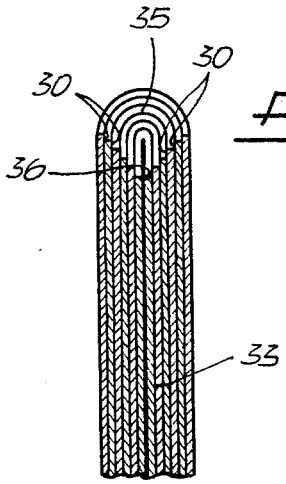
FIG. 13 is a section along plane X in FIG. 11.

Since during folding, the inner layers of the sheet are folded with a smaller radius of curvature than the outer layers, as can be clearly seen in FIG. 13, it results in a fanning of the longitudinal borders of the rectangular slits, so that in the bottom 36 of the recesses, relatively wide longitudinal borders 30 of the slits 31 remain free for application with glue.

Figure 11:
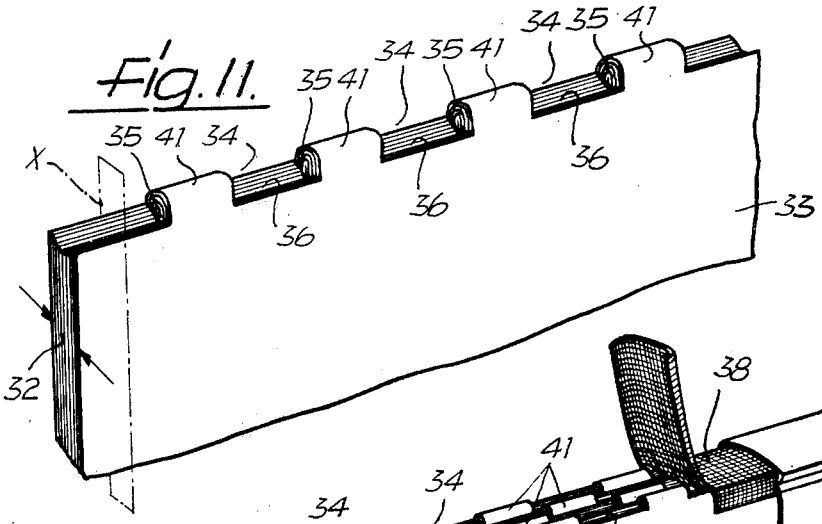
FIG. 11 is a perspective view of the back of a signature in a fragmentary drawing.

If the walls 35 and the bottom 36 of the recesses 34 of the sheet folded into a signature according to FIG. 11 in the folding machine according to FIG. 1 are now coated with glue, the glue then holds all the separate leaves or sheets of the signatures together firmly, since it adheres not only at the longitudinal borders 30 of the slits 29 remaining free in the fanning described above but also penetrates the lateral walls 35 between the edges forming the short sides of the rectangular slits. The booklet thus produced from one signature can already form a book in its simplest form. As a rule, glue is applied to the whole back of the signature so that a tape extending only over the back of the signature, or a cover with its back, can be attached to the signature. Moreover, the pages or sheets of the signature which lies in one layer before the last folding, are joined to one another by the bars 41 remaining between the recesses 34, so that separate pages cannot fall out.

Figure 12:
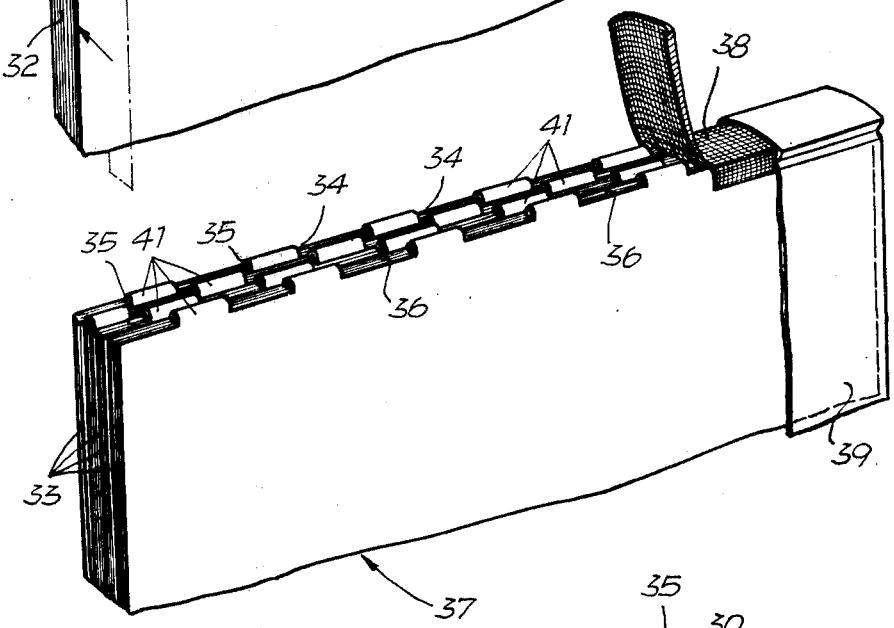
FIG. 12 is a perspective representation of the back of a book in a fragmentary drawing.

FIG. 12 represents an inner book 37 which comprises several signatures 33 folded in the folding machine according to FIG. 1.

The separate backs of the signatures form the back of the inner book 37, to which glue is applied, which also penetrates the recesses 34 of the separate signature backs. Then a tape 38 is glued to the back of the inner book, which holds the signatures 33 together. Thus not only the separate leaves of the signatures, but also the signatures 33 forming the inner book 37 are held together by glue. The inner book thus held together by the tape 38 already forms a book in its simplest form. It can however be bound with a cover 39 in the known way.

Figure 2:
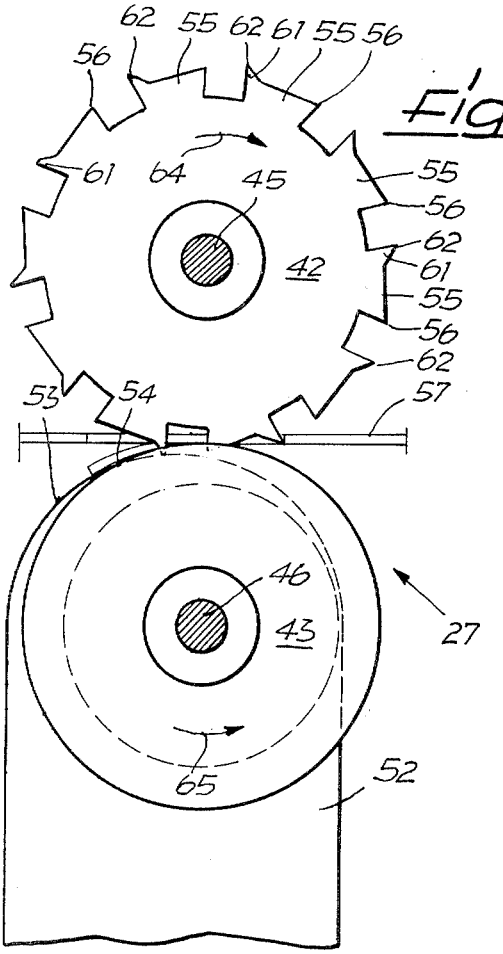
FIGS. 2 and 3 show a greatly enlarged side and front view of the punching mechanism of the folding machine in accordance with FIG. 1, respectively.
Figure 3:
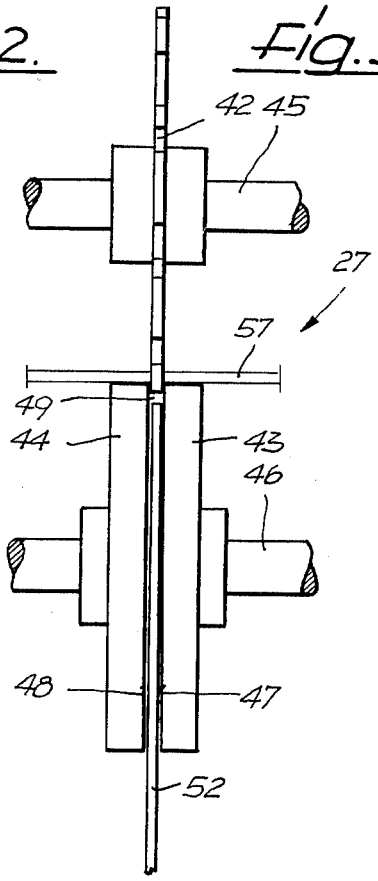
Figures 4, 5, 6:
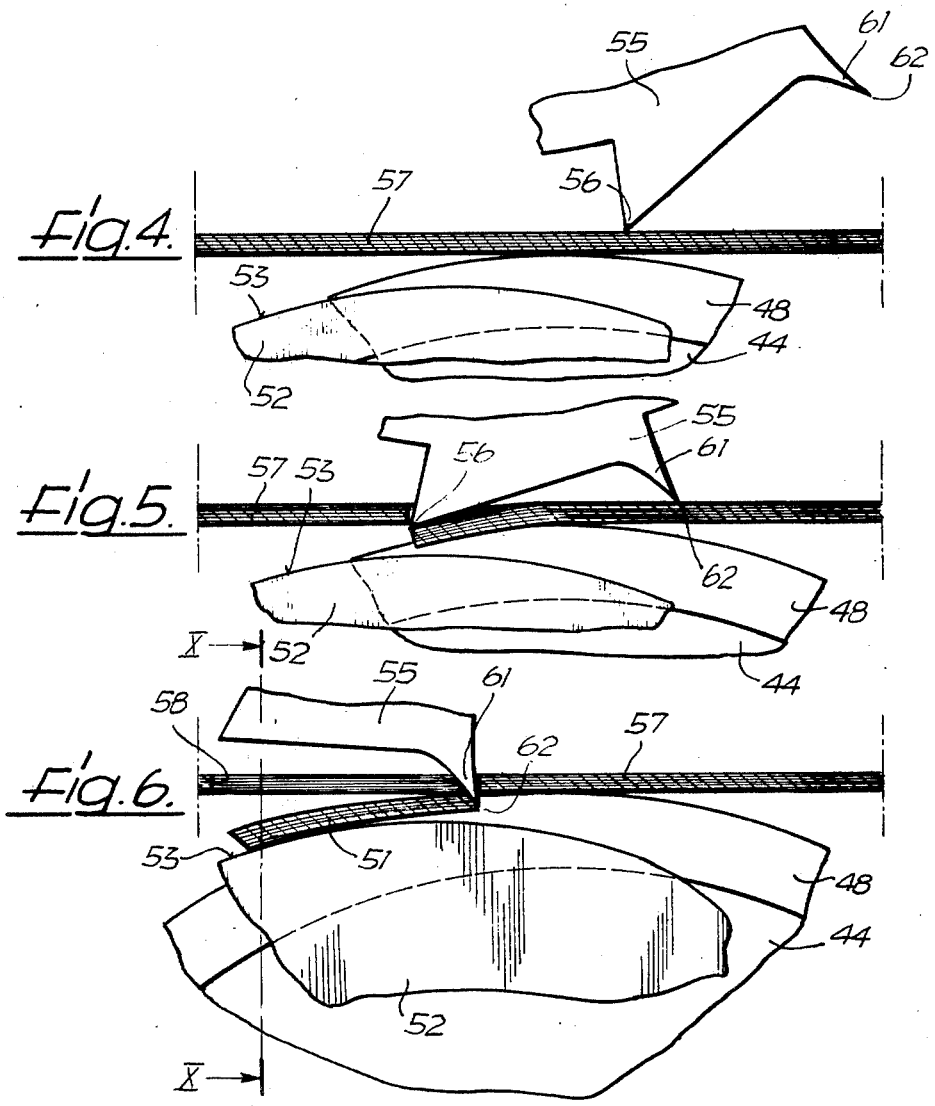
FIGS. 4, 5 and 6 show sections from FIG. 2, further enlarged, showing the position of a cog of the first blade relative to the second and third blades when punching out a slit at three different moments.
Figure 10:
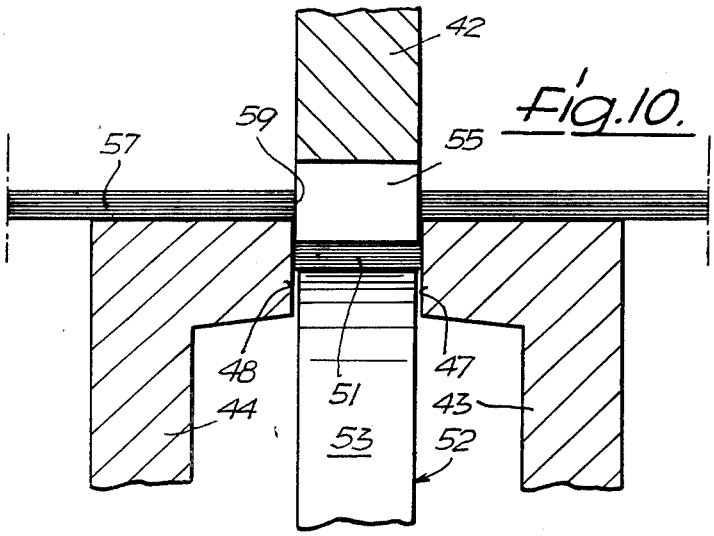
FIG. 10 is a section along lines X-X in FIG. 6.

The perforating mechanism 27 of the folding machine according to FIG. 1 is shown in more detail in FIGS. 2 to 10. As can be seen in FIGS. 2, 3 and 10, this perforating mechanism comprises three rotary blades 42, 43 and 44. The first blade 42 is fixed on a driving shaft 45 above the path, on which the sheet folded in the third folding mechanism 24 moves to the fourth folding mechanism 26. The second rotary blade 43 and the third rotary blade 44 are so fixed on a common driving shaft 46 that the first blade 42 meshes with its rim in the interstice between the second blade 43 and the third blade 44. The inner lateral surfaces 47 and 48 of the blades 43 and 44, respectively, lie in planes parallel to one another and thereby confine a space 49 for the entrance of the first blade 42 and for the removal of the punched out chip 51 (FIGS. 6 and 10). Into this chip removal space 49 enters from the inside an ejector 52, formed as a flat plate, firmly positioned in the machine frame, whose width extends over the interval between both lateral surfaces 47 and 48, which amounts to $\pi/2$ times the thickness of the signature to be folded, without touching them. The surface 53 of this ejector 52 facing the first blade 42 forms a bottom of the chip removal space 49 and has such a curved course that the depth of the chip removal space 49 decreases constantly in the direction of the motion of the circumference of the blades 42, 43 and 44 until zero at the position 54. This surface 53 of the ejector 52 thus forms a ramp which forces the chip 51 which is stuck between the lateral surface 47 and 48 of the blades 43 and 44 out of the chip removal space 49 (FIG. 6).

The rim of the first blade 42 meshing into the chip removal space 49 comprises cogs 55. Each of these cogs 55 is so shaped (FIGS. 4–6) that it forms, during rotation of the first blade 42, on its leading end a first transverse cutting edge 56, which, when a sheet 57 enters the perforating mechanism, first touches the sheet and thereby makes a cut in each separate page of the sheet, forming the first short side 58 (FIG. 7) of the rectangular slit before the cog begins punching out the long sides 59 (FIGS. 8 and 9) of the rectangular slits 29. The trailing end of each cog 55 is provided with a projection 61 which forms a second transverse cutting edge 62, which projects so far from the lateral edges of the cog that it makes a cut in each separate leaf of the sheet 57, forming the second short side 63 of the rectangular slit 29, before punching out of the long sides 59 of the slit is completed.

Figure 7:
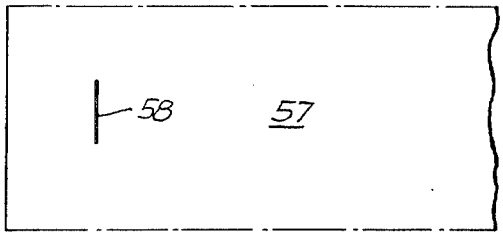
FIGS. 7, 8 and 9 show fragmentary top views of a sheet with the punched lines produced in the positioning of the cog of the first blade relative to the second and third blades in FIGS. 4, 5 and 6, respectively.
Figure 8:
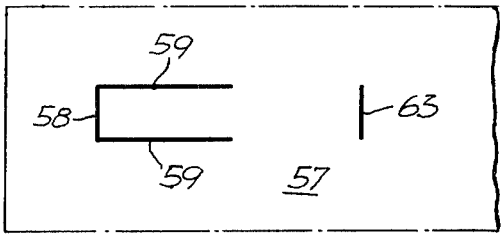

The following mode of operation results from the above description of the perforating mechanism represented in FIGS. 2–10. During operation, the blade 42 rotates in the direction of the arrow 64. Simultaneously blades 43 and 44 rotate together in the direction of the arrow 65. The sheet folded three times in the folding mechanisms 20, 22 and 24, after being folded in the third folding mechanism 24, enters between the blade 42 on one side and the blades 43 and 44 on the other side in such a way that the rectangular slits 29 (FIG. 9) are punched in by the rotaty blade 42 along the fourth fold line, at which the sheet 57 is to be folded afterwards in the fourth folding mechanism 26. In punching a slit, first the first transverse cutting edge 56 meets the sheet 57 and produces a cut forming the first side 58 of the slit 29 (FIGS. 4 and 7). The sheet 57 is hereby supported on both sides of the cut by the circumferential surfaces of the second and third blades 43 and 44, so that the part to be punched out cannot avoid the first transverse cutting edge 56. The parts of the longitudinal sides 59 of the slit 29 adjacent to the first short side 58 are then punched. However, before punching of the longitudinal sides 59 is completed, the second transverse cutting edge 62 meets the sheet 57 and produces a cut forming the second short side 63 (FIGS. 5 and 8). In the sheet 57 the parts of the sheet adjacent to both ends of the short sides 63 are still joined in the area of the slit to be punched out, so that also during execution of this cut, the part to be punched out cannot avoid the second transverse cutting edge. Only when the cut by the second transverse cutting edge 62 has been made in each separate leaf, are the adjacent parts of the longitudinal sides 59 of the slit 29 punched, so that the chip 51 is pressed into the chip removal space 49 by the cog 55, where it is pinched between the lateral surfaces 47 and 48 and thereby moves along with the blades 43 and 44 in the direction of the arrow 65. With continued rotation of the blades 43 and 44, however, the chip is driven out of the chip removal space 49 by the surface 53 of the ejector 52, so that obstruction at the punching area through the chips cannot result.

Because the rectangular slits 29 form a continuous perforation and thereby follow one another at small intervals in a row, corresponding recesses 34 are produced in each signature back so that many more good connection points are provided between the leaves of the signature than is possible with the known wire and thread stitchings, this having been confirmed by tests. Furthermore, due to the many recesses 34 in the separate signatures 33, the outer surface of each separate signature back receiving glue, and consequently that of an inner book 37 comprising several signatures, is much greater than that of a cut-off back, thereby also increasing reception of glue.

The position of the rectangular slits 29 in the separate sheets can be set by regulating the interval between the sheets fed into the folding machine successively. Here it is useful to take care that the recesses 34 in the backs of adjacent signatures 33 which are directly superimposed after being gathered into an inner book 37, are in longitudinally staggered relation to each other as can be seen in FIG. 12. It is thus achieved that the glue applied to the back of the inner book, after hardening, forms a body not only holding the separate signatures together very effectively by sticking but also positively because parts of it which penetrate the recesses 34 form gearings which also hold the signatures 33 together mechanically. For the recesses 34 formed from the slits 29 to be opened for the application of glue in the last folding, and for the greatest possible fanning out of the longitudinal rims 30 of the slits 29 in the floor 36 of the recesses 34 to be achieved, the width of the gap 31 must be at least as great as the thickness 32 of the signature. In the embodiment represented in FIG. 13 the width 31 of the slit 29 is $\pi/2$ times bigger than the thickness of the signature.

What is claimed is:

1. Chip-cutting and ejection mechanism for rectangular-slit perforation of a signature at a perforating location intermediate the respective spaced locations of penultimate and final folding operations of a machine for folding a signature from a single sheet wherein the penultimately folded sheet has in the machine a predetermined path of movement in the direction of its final fold axis and into position for the final-folding operation, said mechanism comprising a peripherally cogged first circular blade mounted on a first rotary axis offset on one side of said path and transverse to said path, second and third circular blades mounted on a second rotary axis parallel to said first axis and offset on the other side of said path, said second and third blades having spaced opposed parallel radial-plane surfaces, the cogs of said first blade meshing in the space between said second and third blades and said blades being adapted for driven rotation such that the speed of sheet movement is substantially matched at the blade-meshing location, the cogs while moving in meshed engagement with said second and third blades defining an arcuate blade meshing region, said radial-plane surfaces of said second and third blades being circumferentially continuous throughout at least the full radial extent of the blade-meshing region thereof, the meshing portion of each cog of said first blade being characterized by a first radially projecting transverse cutting edge at its rotationally leading end and by a second radially projecting transverse cutting edge at its rotationally trailing end, with a radially relieved longitudinal-edge cutting profile between said radially projecting ends, said projecting ends extending radially sufficient beyond said relieved cutting profile as to assure their cutting both longitudinal ends of each rectangular slit before punch-out of the longitudinal sides of the slit is completed, whereby punched-out chips are at least initially rotationally transported by and between said radial-plane surfaces, and ejector mechanism including an intercepting element extending between said radial-plane surfaces and in the rotary path of transported chips.

2. Mechanism according to claim 1, in which said intercepting element includes a fixed ramp inclined to the path of transported chips, the inclined direction of said ramp being such in relation to the direction of chip transport as to lift and eject chips from retention by said second and third blades in the course of blade rotation.

3. Mechanism according to claim 1, in which the distance between the radial-plane surfaces of the second and third blades is at least $\pi/2$ times the thickness of the thickest signature to be folded by said machine.

* * * * *